US006186827B1

(12) United States Patent
Okabe

(10) Patent No.: US 6,186,827 B1
(45) Date of Patent: Feb. 13, 2001

(54) CONNECTOR SUPPORTING MECHANISM

(75) Inventor: Toshiaki Okabe, Shizuoka-ken (JP)

(73) Assignee: Yazaki Corporation, Tokyo (JP)

( * ) Notice: Under 35 U.S.C. 154(b), the term of this patent shall be extended for 0 days.

(21) Appl. No.: 09/580,649

(22) Filed: May 30, 2000

(30) Foreign Application Priority Data

May 31, 1999 (JP) ..... 11-152790

(51) Int. Cl.[7] ..... H01R 13/73
(52) U.S. Cl. ..... 439/544; 439/157; 439/557
(58) Field of Search ..... 439/544, 557, 439/565, 567, 157, 160, 152, 310

(56) References Cited

U.S. PATENT DOCUMENTS 6,050,838 * 4/2000 Norizuki et al. ..... 439/310
6,093,040 * 7/2000 Kodama et al. ..... 439/310

FOREIGN PATENT DOCUMENTS 10-21992 1/1998 (JP) .

* cited by examiner

*Primary Examiner*—Paula Bradley
*Assistant Examiner*—Tho D. Ta
(74) *Attorney, Agent, or Firm*—Finnegan, Henderson, Farabow, Garrett & Dunner, L.L.P.

(57) ABSTRACT

A mounting opening 26 is formed. A first connector 30 comprises a first connector body 31 and an engaging lever 32 which is pivotally supported by a pivot 33 such that the engaging lever 32 project from a rear end surface of the first connector body 31. Projecting from one end of the engaging lever 32 are an engaging projection 43 engaging with a back surface side of a mounting plate 21 around the mounting opening 26, and a cam lever 42 engaging with a front surface side of the mounting plate 21 nearer to the pivot 33 than to the engaging projection 43. A connecting projection 40D projects from the other end of the engaging lever 32. An inner wall of the second connector 50 to which the first connector 30 is fitted is formed with a guide groove 54A for guiding the connecting projection 40D in its fitting direction at an initial fitting stage to the first connector 30, and a curved groove 54B for guiding the connecting projection 40D in a direction other than the fitting direction after the first connector 30 is fitted. Therefore, since the cam lever 42 abuts against the panel and functions as a fulcrum, it is possible to reliably fit the second connector 50 to the first connector 30.

5 Claims, 9 Drawing Sheets

CONNECTOR SUPPORTING MECHANISM

BACKGROUND OF THE INVENTION

1. Field of the Invention

The present invention relates to a connector supporting mechanism, and more particularly, to a connector supporting mechanism for supporting and fixing a pair of female and male mutually connected connectors to a supporting body.

2. Description of the Related Art

Conventionally, as a connector supporting mechanism of this kind, there is known a technique as described in Japanese Patent Application Laid-open No. H10-21992. This related art has a structure as shown in FIGS. 1 to 3. A connecting mechanism of this conventional connector will be explained with using FIGS. 1 to 3 below.

This connector connecting mechanism comprises a holder 2 mounted into a mounting hole 1A formed in a subject member 1 such as a stay member of an automobile as shown in FIG. 1, a first connector 3 which is slidably fitted in the holder 2, a second connector 5 connected to an electronic unit 4, and a swinging lever 6 swingably supported at a pivot 6A by the first connector 3 for driving in a direction to the second connector 5 to the first connector 3.

The holder 2 is formed into a substantially cylindrical shape, and includes a pair of upper and lower horizontal plates 7 and 8, and a pair of left and right side plates 9 and 10 as shown in FIG. 1. The holder 2 is inserted into the mounting hole 1A formed in the subject member 1 and fixed therein by fixing means such as screw. The side plates 9 and 10 of the holder 2 are formed at their inner wall surfaces with guide grooves 11 and 12 along the longitudinal direction for slidably guiding the first connector. The horizontal plate 7 is formed with a guide groove 13 with which an engaging pin 6B projecting from an upper surface of a rear end of the swinging lever 6 is engaged and guided. The guide groove 13 comprises an introducing portion 13A rearwardly extending from a front end of the holder 2, an arc driving grove portion 13B extending from an end of the introducing portion 13A rearwardly and inwardly, and a locking groove portion 13C extending from an end of the driving groove portion 13B rearwardly. The driving groove portion 13B guides the engaging pin 6B along an arc as the first connector 3 is inserted into the holder 2. With the motion of this engaging pin 6B, the swinging lever 6 swings.

An engaging groove 6C is formed in a lower surface of a front end of the swinging lever 6. A driven pin 5A projecting from the second connector 5 engages the engaging groove 6C. Another swinging lever 6 is also formed on the other side surface of the first connector 3. Another driven pin 6A (not shown) is also projecting from the other side surface of the second connector such as to correspond to the other swinging lever formed on the other side surface. In FIG. 1, the reference symbol 3A represents a pair of slide projections projecting from a rear end of each of opposite sides of the first connector 3. The slide projections 3A are guided by the guide grooves 11 and 12 formed in the inner walls of the side plates 9 and 10 of the holder 2. As shown in FIGS. 1 and 3, a temporarily mounting portion 3B for temporarily mounting the first connector 3 into a front opening of the holding is formed between each of the pair of the slide projections formed on both sides of the first connector 3. Further, as shown in FIGS. 1 and 3, a pair of falling-out preventing projections 3C and 3C are projecting from each of the opposite sides of the rear end of upper and lower surfaces of the first connector 3. Falling-out preventing portions 2A are formed on the front end opening peripheral edges of the holder 2 so as to correspond to the falling-out preventing projections 3C and 3C. The projections 3C are fitted into temporarily mounting positions of the holder 2 for preventing the first connector 3 from falling out from the holder 2 by the falling-out preventing portions 2A.

However, according to the connecting mechanism of the connectors, the first connector 3 is supported by the lock arm of the holder 2 mounted to the opening formed in the panel side, but there is an adverse possibility that the first connector 3 is disengaged and brought into a half-fitted state before the first connector 3 is actually fitted due to distortion of the first connector 3 or the like.

Further, according to the connecting mechanism of the connectors, it is necessary to mount the holder 2 to the mounting hole 1A formed in the subject member 1 before the first connector 3 and the second connector 5 are mounted to the subject member 1 such as a stay member of an automobile, and there is a problem that the number of parts is increased. Especially, in the prior art, since the swinging lever 6 is rotated and driven if the engaging pin 6B engaged in the guiding groove 13 of the holder 2 is guided, it is necessary to precisely set size and shape of the guide groove 13 formed in the holder 2.

Further, according to the above-described conventional mechanism, in order to temporarily mount the first connector 3 to the holder 2 at an initial position of the inserting motion, it is necessary to form the temporarily mounting portion on the side of the first connector 3. As a result, it is necessary to form the temporarily mounting projection 2B also on the side of the holder 2 as shown in FIG. 3. In addition, in order to prevent the first connector 3 inserted into the initial position of the inserting motion from falling out from the holder 2, it is necessary to form the falling-out preventing projections 3C on the first connector 3, and to form the falling-out preventing portions 2A also on the side of the holder 2. In the conventional mechanism, since the temporarily mounting mechanism and the falling-out preventing mechanism are formed on each of the members, there is a problem that the mechanisms become complicated. Therefore, according to the conventional connector connecting mechanism, since the number of parts is great and mechanisms are complicated, a mounting space is required, and the mounting operation is complicated. For these reasons, in the conventional engaging mechanism, there is a problem that the costs of parts and operational costs are high.

Further, the temporarily mounting portion 3B formed on the first connector 3 and the falling-out preventing portions 2A formed on the holder 2 are portions which are set such that they are resiliently deformed when the first connector 3 is inserted into the holder 2. There is an adverse possibility that these portion may be bent or damaged by strong external force caused when a wire harness connected to the first connector 3 is handled or when the holder 2 and the first connector 3 are assembled at improper position.

Further, in the conventional connector connecting mechanism, when the first connector 3 is inserted into the subject member 1 such as a stay member of an automobile, it is necessary to fit the engaging pin 6B projecting from the rear end of the swinging lever 6. In the state in which the first connector 3 is inserted into the holder 2 in this manner, since the swinging lever 6 can swing freely, there are problems that some experience is required to insert the engaging pin 6B into the introducing portion 13A of the guide groove 13, and the assembling operation is complicated.

SUMMARY OF THE INVENTION

It is an object of the present invention to provide an inexpensive connector supporting mechanism capable of reducing the number of parts and an assembling operation can easily and reliably be carried out.

According to a first aspect of the present invention, there is provided a connector supporting mechanism comprising a mounting plate, a first connector supported by the mounting plate, a second connector to be fitted and electrically connected to the first connector, wherein the mounting plate is formed with a mounting opening, the first connector comprises a first connector body and an engaging lever pivotally supported by a rotation supporting shaft such that one end of the engaging lever projects from one end surface of the connector body, a first engaging projection engaging with a back surface of the mounting plate around the mounting opening and a second engaging projection engaging a front surface of the mounting plate located nearer to the rotation supporting shaft than to the first engaging projection project from the one end of the engaging lever, a connecting projection projects from the other end of the engaging lever, and an inner wall of the second connector to which the first connector is to be fitted is formed with a straight guide groove for guiding the connecting projection in its fitting direction at an initial fitting stage to the first connector, and is formed with a bending guide groove for guiding the connecting projection in a direction other than the fitting direction after the first connector is fitted.

According to the first aspect, the first engaging projection at a tip end of the engaging lever inserted to he plate back surface side from the mounting opening formed in the mounting plate engages the back surface of the mounting plate and is supported. When the second connector is fitted to the first connector, the connecting projection moves along the straight guide groove formed at the side of the second connector and therefore, the engaging lever can limit the turning motion with respect to the first connector body. Thus, it is possible to reliably fit and assemble the first and second connectors at the initial fitting stage. After the first connector is fitted, since the bending guide groove of the second connector guides the connecting projection in the direction other than the fitting direction, the engaging lever is turned and the first engaging projection reliably engages the back surface of the subject panel (also refer to herein as the mounting plate) and is supported.

According to a second aspect of the present invention, in the above connector supporting mechanism, at least one notch is formed in a periphery of the mounting opening, the first engaging projection is inserted to the back surface side of the subject panel through the notch.

According to the second aspect, the first engaging projection can be inserted through the notch formed in the periphery of the mounting opening of the subject panel. Thus, it is possible to easily mount the first connector to the subject panel.

According to a third aspect of the present invention, in the above connector supporting mechanism, the second engaging projection is located sideway with respect to a line connecting the first engaging projection and the rotating supporting shaft so as to bring the first engaging projection into engagement with the front surface of the subject panel when the first engaging projection is inserted through the notch.

According to the third aspect, the second engaging projection is located sideway with respect to the line connecting the first engaging projection and the rotating supporting shaft. Therefore, the second engaging projection can be engaged with the subject panel in a state where the first engaging projection is inserted through the notch. Thus, the subject panel and the second engaging projection can be brought into abutment without turning the engaging lever, and when the second connector is assembled to the first connector, the tip end of the second engaging projection acts as a fulcrum to hold the first connector.

According to a fourth aspect of the present invention, in the above connector supporting mechanism, the straight guide groove and the bending guide groove are formed such that the connecting projection slides on the straight guide groove at the initial fitting stage between the first and second connectors, and such that the engaging lever is turned after the first and second connectors are fitted to each other, and the first engaging projection is brought into contact with the back surface side of the subject panel under pressure as the engaging lever is turned.

According to the fourth aspect, in the initial fitting stage between the first and second connectors, the connecting projection slides on the straight guide groove to restrain the engaging lever from turning, and after the first and second connectors are fitted to each other, the connecting projection slides on the bending guide groove to turn the engaging lever. That is, in the fitting state between the first and second connectors, the first engaging projection comes into contact with the back surface side of the subject panel under pressure to complete the support of the connectors. Therefore, when the second connector is assembled to the first connector, since the engaging lever will not turn at the initial fitting stage, the second engaging projections acts as a fulcrum to receive the pushing force when the second connector is pushed toward the first connector, and the connectors can reliably be fitted to each other. Further, in a state where most portions of the second connector is fitted to the first connector, the first engaging projection comes into contact with the back surface side of the subject panel under pressure, and the first and second connectors can reliably be supported.

According to a fifth aspect of the present invention, in the above connector supporting mechanism, stoppers which are located on the back surface side of the subject panel and which are capable of abutting against the back surface in a state where the stoppers are supported by the subject panel project from opposite sides of the one end of the first connector body, resilient members which abut against the back surface with repulsion force project from the other end of the stoppers, the second engaging projection and the two resilient members are brought into contact with the subject panel under pressure in a state where only the first connector is supported by the subject panel.

According to the fifth aspect, when the first engaging projection is inserted toward the back surface of the subject panel, and the second engaging projection is abutted against the back surface side of the subject panel, the resilient members on the opposite sides of the first connector body engage the back surface of the subject panel with repulsion force. Therefore, the first connector is supported at three locations thereof, i.e., at two locations of the resilient members and at one location of the tip end of the second engaging projection. Thus, it is possible to temporarily mount the first connector to the subject panel. In this state, the first connector will not fall out from the subject panel, and it is unnecessary to provide any fixing means. Therefore, according to the present invention, it is possible to reduce the number of parts of the connector supporting mechanism.

DETAILED DESCRIPTION OF THE PREFERRED EMBODIMENTS

Figure 1:
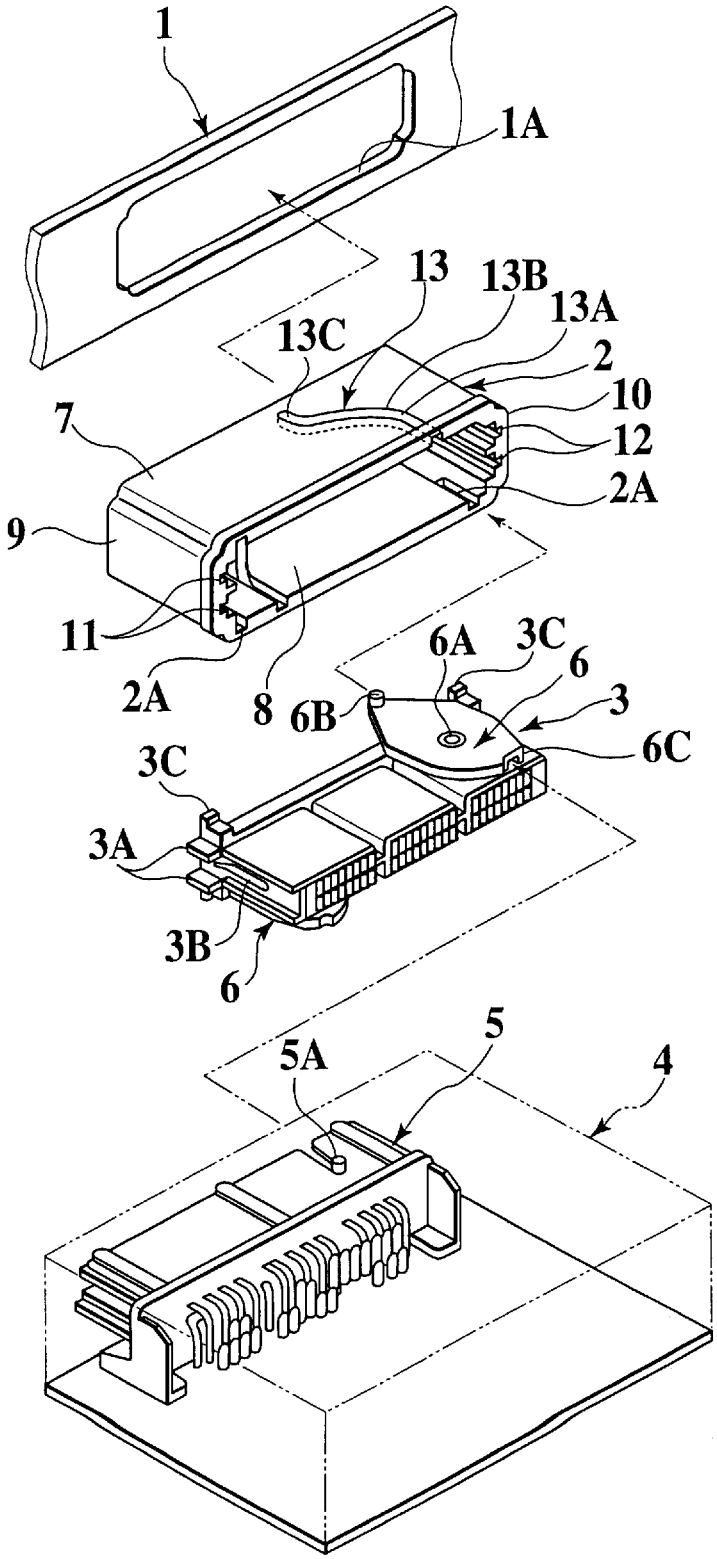
FIG.1 PRIOR ART
FIG. 1 is an exploded perspective view showing a conventional connector supporting mechanism.
Figure 2:
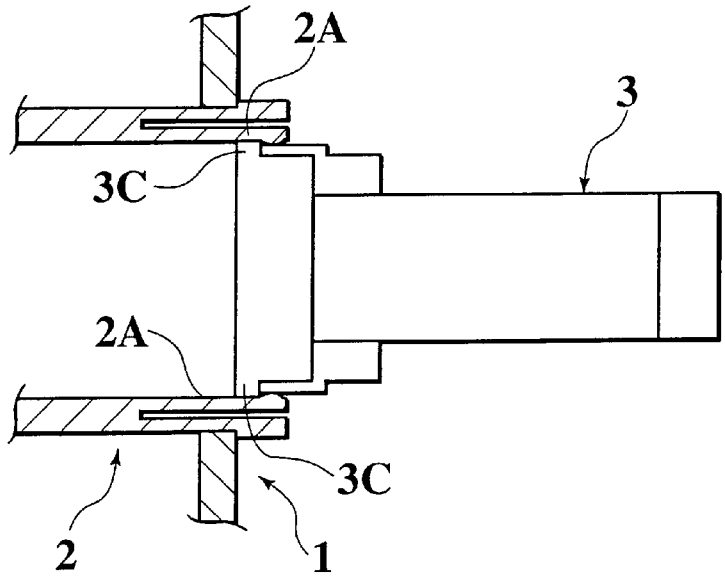
FIG.2 PRIOR ART
FIG. 2 is a partial side sectional view showing the conventional connector supporting mechanism.
Figure 3:
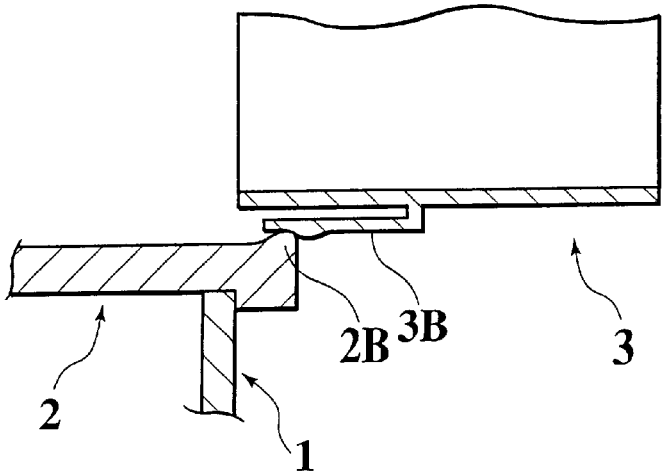
FIG.3 PRIOR ART
FIG. 3 is a plan sectional view of an essential portion of the conventional connector supporting mechanism.

Details of a connector supporting mechanism according to the present invention will be explained based on an embodiment shown in the drawings.

FIGS. 4 to 11 show a first embodiment of a connector supporting mechanism according to the present invention. The connector supporting mechanism of the present embodiment comprises a subject member 20, a first connector 30 as a male connector to be mounted to the subject member 20, and a second connector 50 as a female connector to be mounted to the first connector 30.

Figure 4:
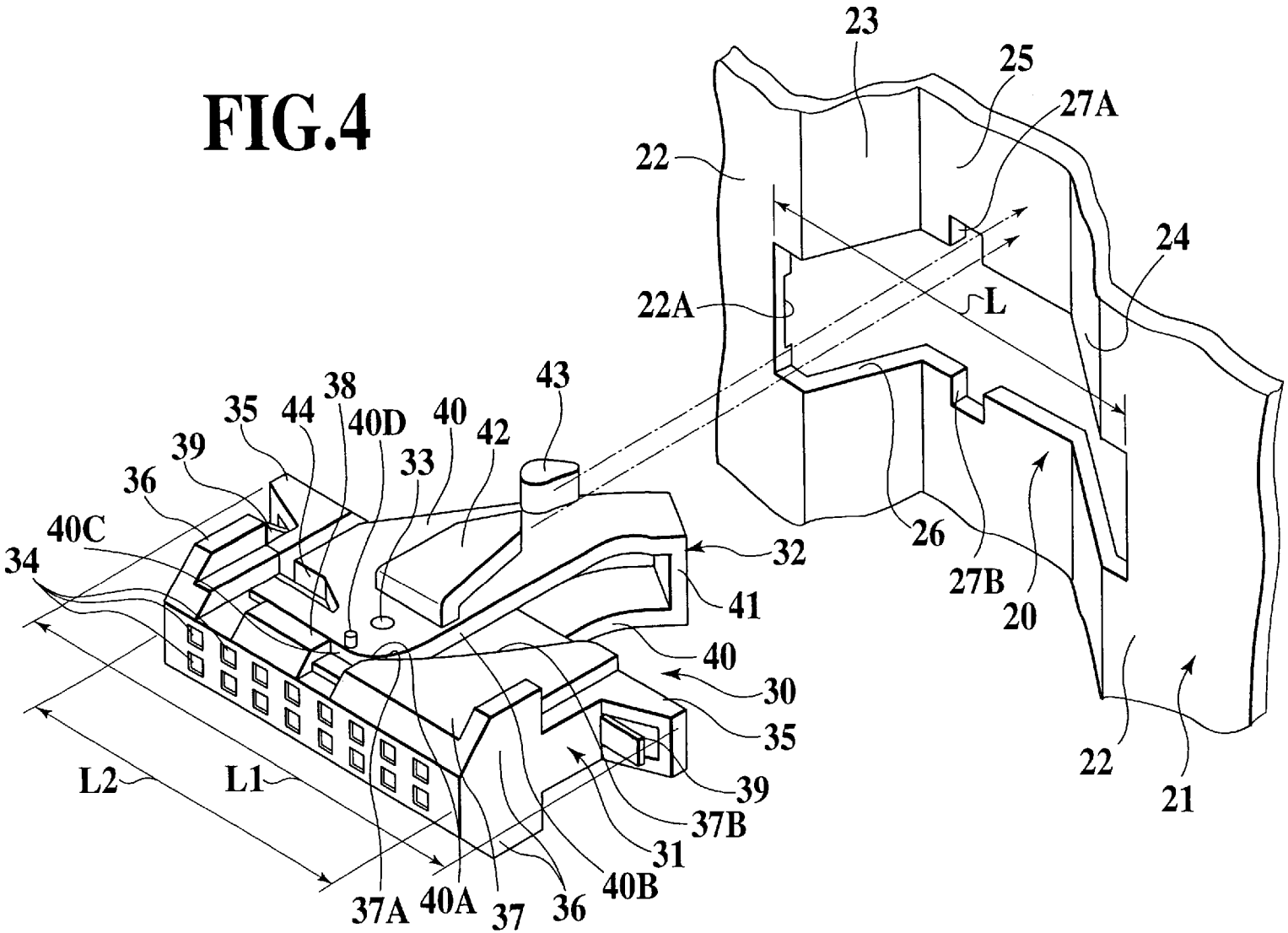
FIG. 4 is a perspective view showing a subject member and first connector constituting a connector supporting mechanism according to a first embodiment of the present invention.

First, a structure of the subject member 20 (also refer to herein as the mounting plate) will be explained. The subject member 20 is formed on a stay member 21 of an automobile for example. As shown in FIG. 4, this subject member 20 includes two inclined surfaces 23 and 24 forming a recess groove with respect to reference surfaces 22 and 22 of the stay member 21, and a bottom surface 25. The subject member 20 is also formed with a mounting opening 26 having a width narrower than a maximum width of a first connector 30 which will be described later. The opening 26 is formed from the entire width of the recess groove formed by the inclined surfaces 23, 24 and the bottom surface 25 to the reference surfaces 22 and 22 on opposite sides.

Insertion notches 27A and 27B through which engaging projections 43 and 43 formed on the first connector 30 which will be described later are formed in upper end lower side edges of the bottom surface 25 facing the mounting opening 26. Recess groove-like steps 22A and 22A each having a predetermined length from the opening 26 to widthwise outward are formed on back surfaces of the reference surfaces 22 and 22 facing the mounting opening 26.

Figure 5A:
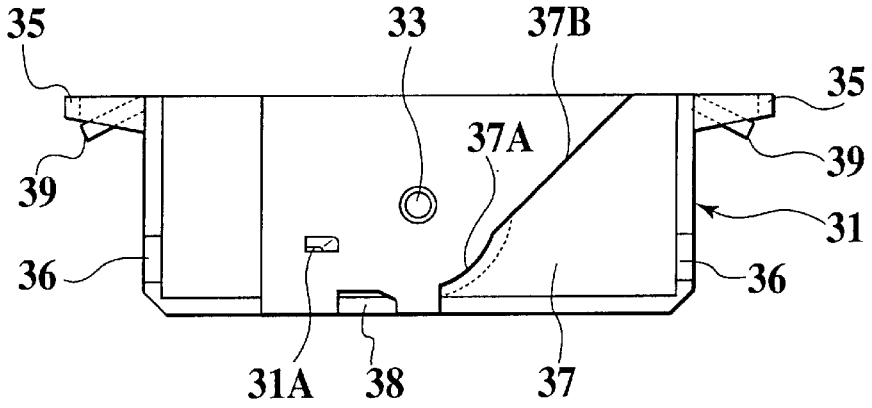
FIG. 5A is a plan view showing a first connector body according to the first embodiment.

Next, a structure of the first connector 30 will be explained. As shown in FIG. 4, the first connector 30 includes a substantially rectangular first connector body 31, and an engaging lever 32 which is pivotally supported by pivots 33 and 33 at upper and lower surfaces of the substantially rectangular first connector body 31. As shown in FIGS. 4 and 5A, the first connector body 31 is formed with a plurality of terminal accommodating chambers 34 which longitudinally pass through the first connector body 31. In the present embodiment, female terminal metal fittings are accommodated in the terminal accommodating chambers 34. Electric wires are connected to the female terminal metal fittings. These electric wires are led out from one end (rear end, hereinafter) of the first connector body 31 and led toward the back surface of the stay member 21 through the mounting opening 26.

Figure 5B:
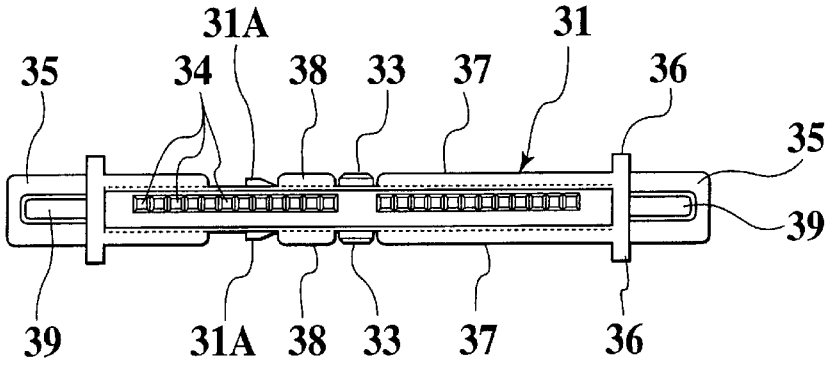
FIG. 5B is a front view thereof.
Figure 5C:
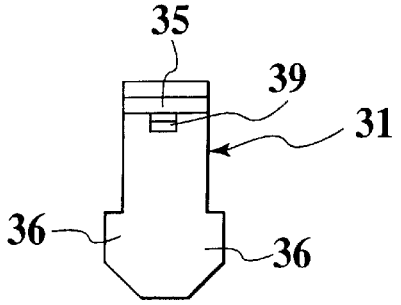
FIG. 5C is a side view thereof.

As shown in FIGS. 4, 5A and 5B, stoppers 35 project sideway from opposite sides of the rear end from which the wires of the first connector body 31 are led out. FIGS. 5A to 5C show a state in which the engaging lever 32 is not mounted to the first connector body 31. As shown in FIG. 4, a length L1 between tip ends of these stoppers 35 and 35 is set longer than a width L of the mounting opening 26 of the stay member 21. A width L2 of the first connector body 31 is set slightly shorter than the width L of the mounting opening 26. Each of the stopper 35 is provided at its front side with a resilient piece 39 biased in a direction separating away from the stopper 35. This resilient piece 39 exhibits a holding force during an initial stage for mounting the first connector 30 to the subject member 20 as will be explained later.

Further, a pair of vertically projecting guide projections 36 and 36 are formed on opposite sides of the other end (front end, hereinafter) of the first connector 30. Upper and lower surfaces of the front end of the first connector 30 are formed with a first projection 37 having substantially triangular plane and a second projection 38 having substantially rectangular plane for restricting a rotation range of the engaging lever 32. In FIGS. 5A and 5B, the reference symbol 31A represents a temporarily mounting projection for temporarily mounting the engaging lever 32.

Figure 6B:
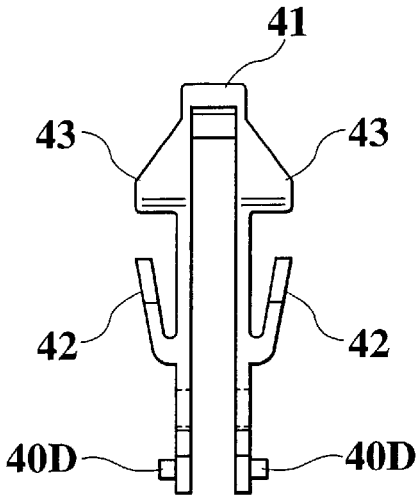
FIG. 6B is a side view thereof.
Figure 6A:
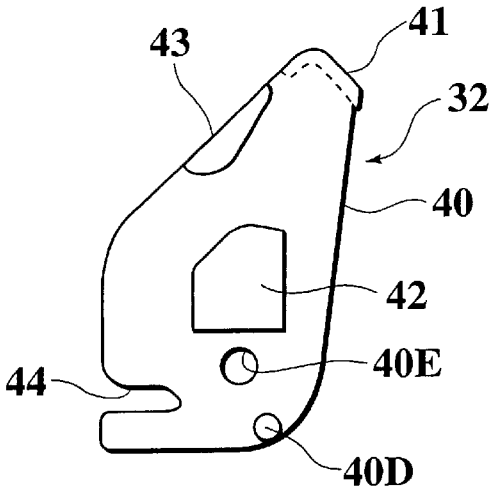
FIG. 6A is a plan view showing an engaging lever according to the first embodiment.
Figure 6C:
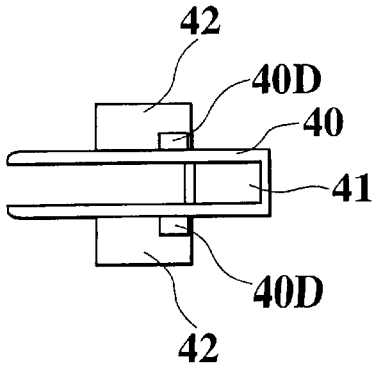
FIG. 6C is a front view thereof.

The engaging lever 32 comprises a pair of lever plates 40 and 40 whose base ends are pivotally supported on the upper and lower surface of the first connector body 31 by the pivots 33 and 33, and a connecting plate 41 for integrally connecting free ends of the lever plates 40 and 40. FIGS. 6A to 6C show the engaging lever 32 in a state where it is not mounted to the first connector body 31.

One side peripheral edges 40A at base ends of the lever plates 40 and 40 are set such as for form arcs whose centers correspond to the pivots 33. Further, the side peripheral edge 40A and the front surface 37A of the first projection 37 having the substantially triangular plane are set to be located in position opposed to each other. The front side surface 37A is formed such as to curve in correspondence with the side peripheral edge 40A of the lever plate 40. Therefore, the side peripheral edge 40A rotates along the front side surface 37A of the first projection 37 around the pivot 33.

Side surfaces 40B of the lever plates 40 and 40 facing the first projection 37 are set such as to be opposed to the rear side surface 37B of the first projection 37. The rear side surface 37B is extended rearward of the front side surface 37A and formed into flat surface. With this structure, the rear side surface 37B of the first projection 37 abuts against the side surface 40B of the lever plate 40, thereby restricting the rotation range of the engaging lever 32. The second projections 38 are disposed and formed on front ends of the upper and lower surfaces of the first connector body 31. The rear side surfaces of the second projections 38 abut against side surfaces 40C of the base ends of the lever plates 40, thereby restricting the rotation range of the engaging lever 32.

Further, connecting projections 40D are formed such as to project from front ends of the lever plates 40 in the vicinity of the side peripheral edges 40A. Cover levers 42 are formed on the opposite side of the connecting projection 40D with respect to the pivots 33. Engaging projections 43 having height lower than that of the cover levers 42 are projected form the lever plates 40 at locations closer to free ends of the cover levers 42. Each of the engaging projections 43 is disposed sideway (in a direction separating away from the side surface 40B of the lever plate 40) from a line connecting the cam lever 42 and the pivot 33. As described above, the engaging projections 43 are inserted through the insertion notches 27A and 27B formed in the upper and lower side edges of the mounting opening 26 of the subject member 20. At that time, since the projecting height of the cam lever 42 is higher than that of the engaging projection 43, and the cam lever 42 is formed sideway (in a direction approaching the side surfaces 40B of the lever plates 40) of the engaging projection 43, the cam lever 42 can not pass through the insertion notches 27A and 27B.

Further, temporarily mounting notches 44 capable of engaging with and disengaging from the temporarily mounting projections 31A projecting from the upper and lower surfaces of the first connector body 31 are formed in the peripheral edges of the sideway (in a direction separating away from the side surfaces 40B of the lever plates 40) of the portions of the lever plates 40 pivotally supported by the pivots 33.

Figure 9:
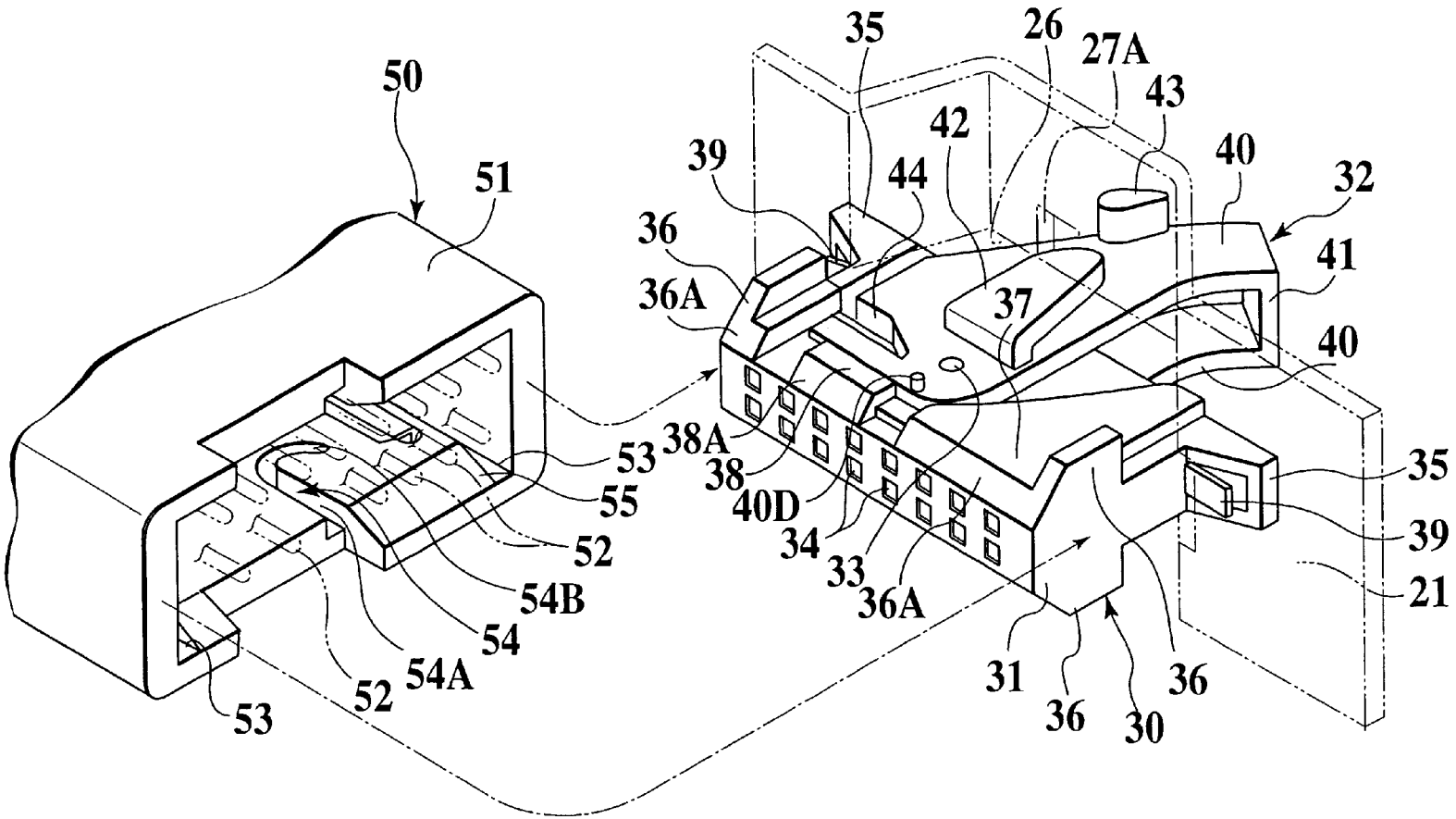
FIG. 9 is a perspective view showing a state in which a second connector is mounted to the temporarily mounted first connector in the first embodiment.

Next, a structure of a second connector 50 will be explained using FIG. 9. As shown in FIG. 9, the second connector 50 comprises a prism-like second connector body 51 into which the first connector 30 is fitted and accommodated, and a plurality of male terminal metal fitting 52 disposed in the second connector body 51. Guide grooves 53 and 53 for guiding the guide projections 36 and 36 of the first connector body 31 are formed in opposite sides of upper and lower inner wall surfaces of the second connector body 51. Guide grooves 54 for guiding the connection projections 40D and 40D formed on the engaging lever 32 of the first connector 30 are formed in the opposite sides of the upper and lower inner wall surfaces of the second connector body 51. Each of the guide grooves 54 comprises an introducing groove portion 54A extending straightly from an opening edge of the second connector 50 toward a bottom thereof, and a curved groove portion 54B extending such as to curve from an end of the introducing groove portion 54A sideway. As shown in FIG. 9, guide inclined surfaces 55 for making it easy to guide the front end of the first connector body 31 are formed on the upper and lower wall surfaces of the opening of the second connector body 51.

The structure of the subject member 20, the first connector 30 and the second connector 50 constituting the connector supporting mechanism of the present embodiment has been explained above. Next, assembling method, effect and operation of the present embodiment will be explained.

In the present embodiment, as shown in FIG. 4, the rear end of the first connector 30 is first turned such as to be opposed to the subject member 20. At that time, the electric wires connected to the female terminal metal fittings accommodated and disposed in the first connector 30 may be led backside of the subject member 20 through the mounting opening 26 of the subject member 20, or may be connected to the first connector body 31 after the electric wires are pulled out through the mounting opening 26 from the backside of the subject member 20. In the present embodiment, since the tip end of the engaging lever 32 is bent sideway as shown in FIG. 4, it is easy to pull out the electric wires from the rear end of the first connector body 31.

Figure 7A:
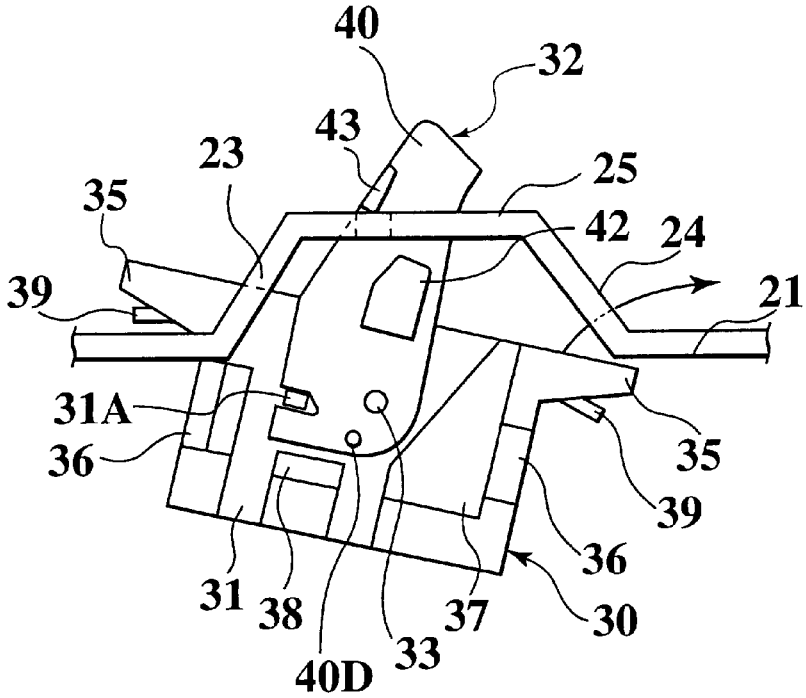
FIG. 7A is a plan view for explaining an initial mounting stage between the subject member and the first connector of the first embodiment.
Figure 7B:
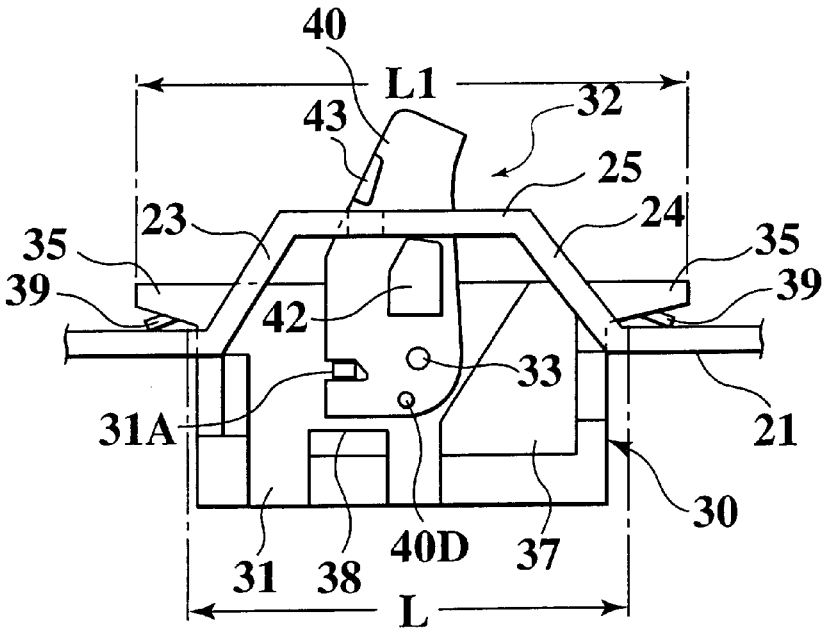
FIG. 7B is a plan view for explaining a state in which the first connector is temporarily mounted in the subject member in the first embodiment.

Next, if the first connector 30 is inclined with respect to the reference surfaces of the stay member 21 as shown in FIG. 7A, the other stopper 35 can pass through the mounting opening 26. At that time, since the temporarily mounting projection 31A projecting from the first connector body 31 is locked to the temporarily mounting notch 44 formed in the lever plate 40 of the engaging lever 32, the engaging lever 32 is kept in its projecting state with a predetermined angle (substantially right angle) with respect to the rear end surface of the first connector body 31. Therefore, the engaging projection 43 formed on the front end of the lever plate 40 passes through the insertion notches 27A and 27A formed in the peripheral edges of the mounting opening 26 and moves to the backside of the bottom surface 25.

Figure 8A:
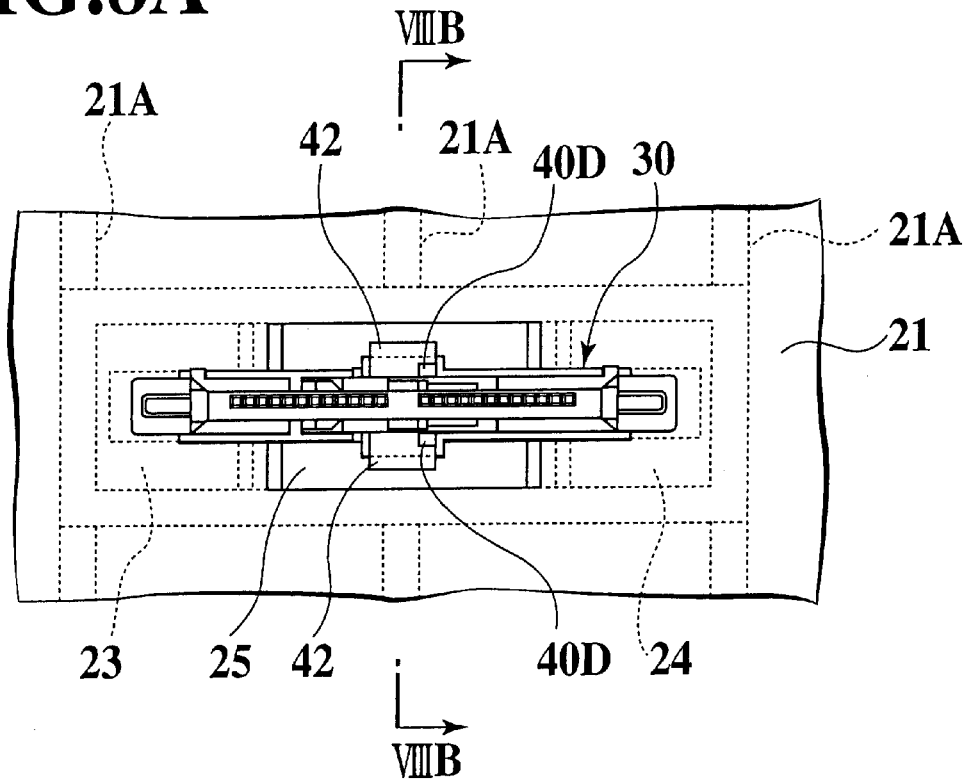
FIG. 8A is a plan view showing a state in which the first connector is temporarily mounted in the subject member in the first embodiment.
Figure 8B:
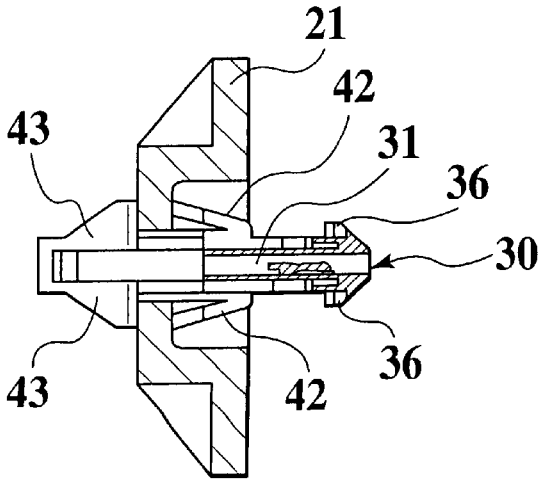
FIG. 8B is a sectional view taken along the line VIIIB—VIIIB in FIG. 8A.

After both the stoppers 35 of first connector 30 pass through the mounting opening 26 and move to backside of the stay member 21, both the resilient pieces 39 are brought into contact under pressure with back surfaces (step portions steps 22A and 22A of the reference surfaces 22 and 22 of the mounting opening 26. As a result, the first connector 30 is biased in a direction in which the first connector 30 is inserted into the mounting opening 26 by repulsion force of the resilient pieces 39, but since the front end of the cam lever 42 formed on the lever plate 40 abuts against the front surface of the bottom surface 25, this biasing force is maintained. Therefore, the first connector 30 is temporarily mounted to the subject member 20. That is, in the present embodiment, it is possible to temporarily mount the first connector 30 by a simple operation in which the first connector 30 is inserted into the mounting opening 26 to bring the resilient pieces 39 and 39 into contact under pressure with the back surfaces (steps 22A and 22A) of the reference surfaces 22 and 22. FIG. 8A is a front view showing a state in which the first connector 30 is temporarily mounted in the subject member 20, and FIG. 5B is a sectional view taken along the line VIIIB—VIIIB in FIG. 8A. As shown in FIG. 8A, by appropriately forming the ribs 21A on the back surface of the stay member 21 for reinforcing the latter. The ribs 21A may not be provided if unnecessary.

Figure 10:
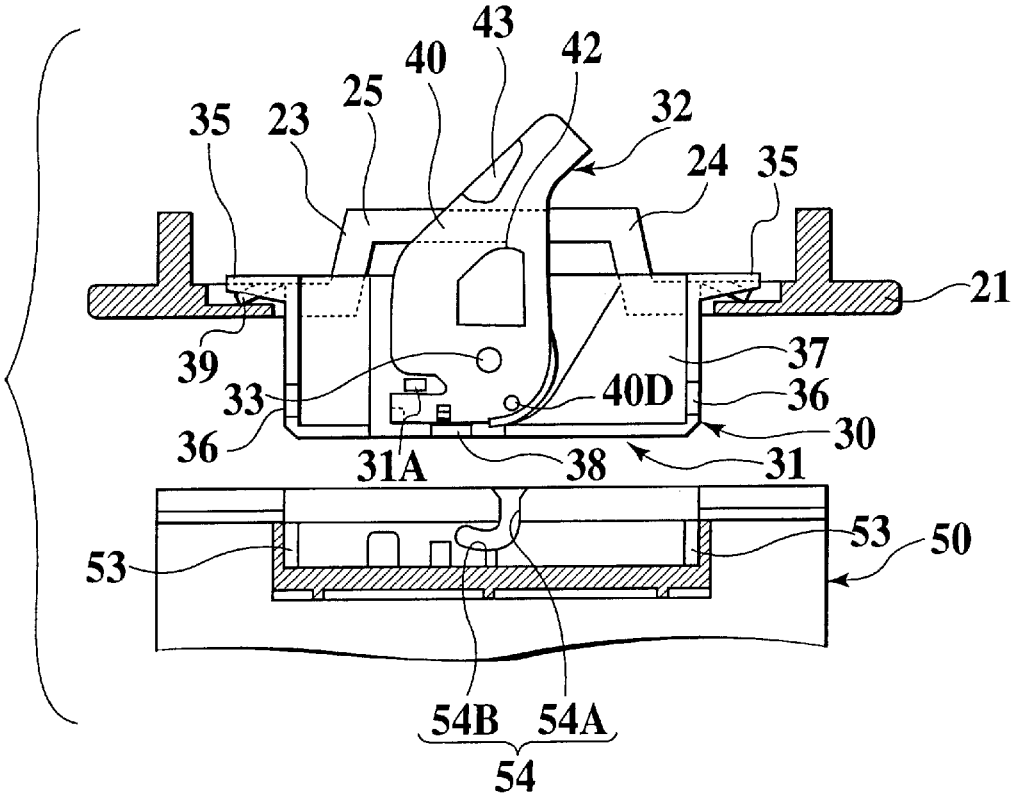
FIG. 10 is a partial sectional view of a flat portion showing a state in which the second connector is mounted to the temporarily mounted first connector in the first embodiment.

Next, as shown in FIGS. 9 and 10, the second connector 50 is mounted to the first connector 30 mounted to the subject member 20. That is, the second connector 50 is allowed to approach the front end surface of the first connector 30 in a state where the opening end surface of the second connector 50 is opposed to the end surface of the first connector 30, and the first connector 30 is fitted into the opening. First, when the opening end surface of the second connector 50 is fitted over the front end of the first connector 30 shallowly, the guide projections 36 of the first connector 30 enter the guide grooves 53, 53 formed on the opposite sides of the upper and lower inner wall surfaces of the second connector 50. In the present embodiment, since the front end surface of each the guide projection 36 is inclined, the guide projection 36 is easily guided into the guide groove 53.

At the same time, the connecting projections 40D formed on the upper and lower lever plates 40 of the engaging lever 32 of the first connector 30 are guided into the introducing groove portions 54A of the connection guide grooves 54 formed in the upper and lower inner wall surfaces of the second connector 50. At the initial mounting stage of first connector 30 and the second connector 50, in the first connector 30, the temporarily mounting projections 31A projecting from the first connector body 31 are locked to the temporarily mounting notches 44 formed in the engaging lever 32, the introducing groove portions 54A and the connecting projections 40D are disposed in the corresponding positions.

Thereafter, if the second connector 50 is pushed in a direction in which the second connector 50 is fitted to the first connector 30, the connecting projections 40D reach the curved groove portions 54B formed at the terminations of the introducing groove portions 54A. If the second connector 50 is further pushed, the connecting projections 40D slide along the curved surfaces of the curved groove portions 54B. If the connecting projections 40D slide along the curved surfaces of the curved groove portions 54B of the second connector 50 in this manner, the engaging lever 32 gets over the temporarily mounting projections 31A to release the engagement, and the engaging lever 32 is turned around the pivots 33. At that time, the cam lever 52 which is in abutment against the front surface of the bottom surface 25 slides and moves on the front surface of the bottom surface 25 together with the engaging lever 32. As shown in the drawing, since the tip end of the cam lever 42 is formed into R-shape, the cam lever smoothly moves on the front surface of the bottom surface 25 as the engaging lever 32 is turned.

Figure 11:
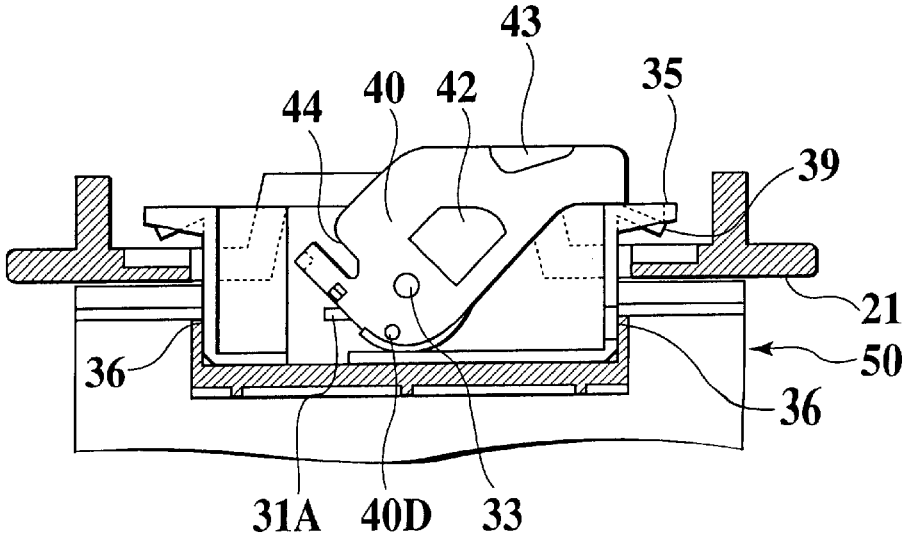
FIG. 11 is a partial sectional view of the flat portion showing a state in which the second connector is mounted to the first connector in the first embodiment.

As a result, as shown in FIG. 11, the engaging lever 32 is turned, and the engaging projections 43 projecting from the tip ends of the lever plates 40 come into contact under pressure with the back surface of the bottom surface 25. At that time, although the tip ends of the cam levers 42 are also pushed backward, since the cam levers 42 come into contact with the front surface of the bottom surface 25 under pressure, the engaging lever 32 is rotated in the clockwise direction in FIG. 8, and the bottom surface 25 is sandwiched between the engaging projection 43 and the cam lever 42 as shown in FIG. 11. In this state, as shown in FIG. 11, the peripheral surface of the lever plate 40 and the temporarily mounting projection 31A are engaged with each other to prevent the lever plates 40 from turning in the opposite direction. As a result, the first connector 30 is supported by and fixed to the subject member 20. Since the second connector 50 is engaged with the connecting projections 40D projecting from the lever plates 40 of the first connector 30 and the curved groove portions 54B, the fitting state is maintained. In the process in which the first connector 30 and the second connector 50 are fitted to each other, the female terminal metal fittings provided on the side of the first connector 30 and the male terminal metal fittings 52 provided on the side of the second connector 50 are fitted to each other, thereby establishing the electric connection.

The assembling method, the effect and the operation of the present embodiment were explained above. In the present embodiment, the second connector 50 is mounted to the first connector 30 in a state where the first connector 30 is temporarily mounted to the subject ember 20. When the mounting operation of the second connector 50 is completed, the first connector 30 is reliably fixed to the subject member 20, and the second connector 50 is also reliably mounted to the first connector 30.

Especially, in the present embodiment, since the first connector 30 can be fixed to the subject member 20 without using special fixing means such as screws, the mounting operation is extremely easy. Further, since the subject member 20, the first connector 30 and the second connector 50 can be integrally and strongly fixed to one another utilizing the inserting force of the second connector 50 in the state where the first connector 30 is temporarily mounted to the subject member 20, force used for the operation can efficiently be utilized, and the mounting operation can be carried out swiftly and reliably. As described above, according to the present embodiment, it is possible to realize an inexpensive connector supporting mechanism capable of reducing the number of parts and an assembling operation can easily and reliably be carried out.

To detach the second connector 50 and the first connector 30 from the subject member 20, the engaging levers 32 get over the temporarily mounting projections 31A and rotate in the opposite direction by pulling the second connector 50, the connecting projections 40D move from the curved groove portions 54B toward the introducing groove portions 54A, and the second connector 50 can be pulled out. Further, if one of the stoppers 35 and one of the resilient pieces 39 of the first connector 30 are detached from the subject member 20, and if the other stopper 35 and the other resilient piece 39 are detached, the first connector 30 can be detached from the subject member 20.

Although the present embodiment has been explained above, the present invention should not be limited to these embodiments, and various changes in design can be made in relation to the subject matter of the structure. For example, although the stoppers 35 and the resilient pieces 39 are provided on the opposite sides of the rear end of the first connector body 31 in the above-described present embodiment, a structure in which the stoppers 35 and the resilient pieces 39 are omitted is also within a range to which the present invention can be applied.

What is claimed is:

1. A connector supporting mechanism comprising:

a mounting plate, a first connector supported by said mounting plate, a second connector to be fitted and electrically connected to said first connector, wherein said mounting plate is formed with a mounting opening, said first connector comprises a first connector body and an engaging lever pivotally supported by a rotation supporting shaft such that one end of said engaging lever projects from one end surface of said connector body, a first engaging projection engaging with a back surface of said mounting plate around said mounting opening and a second engaging projection engaging a front surface of said mounting plate located nearer to said rotation supporting shaft than to said first engaging projection projects from said one end of said engaging lever, a connecting projection projects from the other end of said engaging lever, and an inner wall of said second connector to which said first connector is to be fitted is formed with a straight guide groove for guiding said connecting projection in its fitting direction at an initial fitting stage to the first connector, and is formed with a bending guide groove for guiding said connecting projection in a direction other than said fitting direction after said first connector is fitted.

2. A connector supporting mechanism according to claim 1, wherein said straight guide groove and said bending guide groove are formed such that said connecting projection slides on said straight guide groove at said initial fitting stage between said first and second connectors, and such that said engaging lever is turned after said first and second connectors are fitted to each other, and said first engaging projection is brought into contact with said back surface side of said mounting plate under pressure as said engaging lever is turned.

3. A connector supporting mechanism according to claim 1, wherein stoppers which are located on the back surface side of said mounting plate and which are capable of abutting against said back surface in a state where said stoppers are supported by said mounting plate project from opposite sides of said one end of said first connector body, resilient members which abut against said back surface with repulsion force project from the other end of said stoppers, said second engaging projection and said two resilient members are brought into contact with said mounting plate under pressure in a state where only said first connector is supported by said mounting plate.

4. A connector supporting mechanism according to claim 1, wherein at least one notch is formed in a periphery of said mounting opening, said first engaging projection is inserted to the back surface side of said mounting plate through said notch.

5. A connector supporting mechanism according to claim 4, wherein said second engaging projection is located sideway with respect to a line connecting said first engaging projection and said rotating supporting shaft so as to bring said first engaging projection into engagement with the front surface of said subject panel when said first engaging projection is inserted through said notch.

* * * * *

UNITED STATES PATENT AND TRADEMARK OFFICE

CERTIFICATE OF CORRECTION

PATENT NO. : 6,186,827 B1
DATED : February 13, 2001
INVENTOR(S) : Okabe

It is certified that error appears in the above-identified patent and that said Letters Patent is hereby corrected as shown below:

Title page,
Item (57), in the Abstract,
Line 4, "lever 32 project" should read -- lever 32 projects --.

Column 12,claim 5,
Line 14, "subject panel" should read -- mounting plate --.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*